US011524816B2

(12) United States Patent
Donner et al.

(10) Patent No.: US 11,524,816 B2
(45) Date of Patent: Dec. 13, 2022

(54) PLASTICS SHIPPING BAG

(71) Applicant: Mettler Packaging LLC, Raynham, MA (US)

(72) Inventors: Rene Donner, Morbach (DE); Patrick Eberhard, Morbach (DE)

(73) Assignee: Mettler Packaging LLC, Raynham, MA (US)

( * ) Notice: Subject to any disclaimer, the term of this patent is extended or adjusted under 35 U.S.C. 154(b) by 0 days.

(21) Appl. No.: 17/078,881

(22) Filed: Oct. 23, 2020

(65) Prior Publication Data

US 2021/0122530 A1 Apr. 29, 2021

(30) Foreign Application Priority Data

Oct. 24, 2019 (EP) ..... 19205135

(51) Int. Cl.
*B65D 33/06* (2006.01)
*B65D 33/24* (2006.01)
*B65D 30/20* (2006.01)

(52) U.S. Cl.
CPC ..... *B65D 33/243* (2013.01); *B65D 31/10* (2013.01); *B65D 33/06* (2013.01)

(58) Field of Classification Search
CPC ..... B65D 33/243; B65D 33/06; B65D 31/10
USPC ..... 383/10
See application file for complete search history.

(56) References Cited

U.S. PATENT DOCUMENTS 1,973,236 A * 9/1934 Vierengel ..... B65D 33/243 383/20
2,062,318 A * 12/1936 Lackey ..... B65D 33/243 383/20
2,336,630 A * 12/1943 Nichols, Jr. ..... B65D 33/243 383/10
3,722,785 A 3/1973 Rivman
2003/0234201 A1 12/2003 Shah et al.
2007/0280567 A1* 12/2007 Magnus ..... A45C 11/20 383/105
2018/0086531 A1 3/2018 Lefkow et al.
(Continued)

FOREIGN PATENT DOCUMENTS

EP 1 382 542 A1 1/2004
GB 2549207 A 10/2017
(Continued)

OTHER PUBLICATIONS

Extended European Search Report for Application No. 19 205 135.7, dated Mar. 31, 2020, 6 pages.

*Primary Examiner* — Peter N Helvey
(74) *Attorney, Agent, or Firm* — Seed Intellectual Property Law Group LLP

(57) ABSTRACT

A plastics shipping bag includes a closure flap which projects beyond the front wall, can be folded over the outer face of the front wall, and comprises a passage opening, which is configured and designed for the passage of a handle loop or handle of the front wall and/or rear wall, wherein the closure flap comprises at least one fastening means between the opening edge of the rear wall and the passage opening, which fastening means is configured and designed to close the opening end once the closure flap has been folded over onto the outer face of the front wall. The plastics shipping bag can be used for shipping foods, such as chilled foods.

26 Claims, 9 Drawing Sheets

(56) References Cited

U.S. PATENT DOCUMENTS

| | | | | |
|---|---|---|---|---|
| 2019/0104815 | A1* | 4/2019 | Lowe | A45C 3/04 |
| 2020/0130897 | A1* | 4/2020 | Schmoor | B65D 33/22 |

FOREIGN PATENT DOCUMENTS

| | | | |
|---|---|---|---|
| WO | 2005/092713 | A2 | 10/2005 |
| WO | 2005/092713 | A3 | 10/2005 |

* cited by examiner

PLASTICS SHIPPING BAG

BACKGROUND

Technical Field

The present disclosure relates to a plastics shipping bag which can be used for shipping foods, such as chilled foods.

Description of the Related Art

Shipping bags and shipping pouches have been produced and used in various forms using a wide range of materials for some time. Unlike common carrier bags and packing bags, shipping bags and shipping pouches often have to satisfy specific requirements during packing, transport and delivery in order to ensure that handling is always smooth and uncomplicated. In addition, transport on belt conveyors or transport conveyors has to consistently function without errors. Specific requirements and particular care are needed for shipping bags of this kind, which involve a more complex construction due to the more fragile goods that have to be stored and transported therein. Many attempts have been made in the past to find suitable solutions to specific problems that are posed. Nevertheless, shipping bags, in particular those equipped with carry handles, still leave room for improvement.

There is accordingly a need to provide shipping bags that no longer have the drawbacks of the prior art and can in some cases be easily produced and handled, which nevertheless ensure that fragile or high-value goods, such as food, are transported securely and reliably, even if said bags are equipped with handle loops or handles.

BRIEF SUMMARY

Accordingly, the present disclosure provides a plastics shipping bag comprising a closed or substantially closed base end and an opposite opening end, including a front wall having an inner face and an outer face and a rear wall having an inner face and an outer face, each having a first side edge and an opposite second side edge as well as an opening edge and a base edge. The front wall and the rear wall are interconnected at least in portions, directly or by means of side walls and/or side folds and/or a base fold, in the region of their first and second side edges and base edges, wherein the front wall and optionally the rear wall, in some cases the front wall and rear wall, as well as, optionally, the side walls, are designed to be multi-layered, in some cases double-layered, triple-layered, quadruple-layered or quintuple-layered, at least in portions, in some further cases in the region from the base edge as far as the opening end, comprising an inner layer and an outer layer as well as, optionally, at least one intermediate layer. At least one handle or handle loop is attached to the opening edge, the inner face or the outer face, in some cases the inner face, of the front wall, and/or at least one handle or handle loop attached to the inner face of the rear wall on or below the opening edge. The front wall has a first length which corresponds to the average distance between the opening edge and the base edge of the front wall, and the rear wall has a second length which corresponds to the average distance between the opening edge and the base edge of the rear wall, wherein the first length is shorter than the second length, such that the rear wall projects beyond the front wall at the opening end and this portion (also called a "closure flap") projecting beyond the front wall can be folded onto the outer face of the front wall.

The closure flap comprises a passage opening, in some cases a handle hole or punched hole or an opening slot, in some further cases substantially centrally, which is configured and designed for the passage of the handle loop or handle of the front wall and/or rear wall, in some cases of the front wall and rear wall. The closure flap also comprises at least one fastening means between the opening edge of the rear wall and the passage opening, which fastening means is configured and designed to close the opening end once the closure flap has been folded over onto the outer face of the front wall. Using these plastics shipping bags according to the present disclosure, foods can be transported securely and reliably, and specifically also by a shipping service or shipping company, without the quality or freshness of said foods being impacted. In addition, the plastics shipping bags according to the present disclosure can ensure that transported foods are protected against contamination and that the recipient can identify whether there might have been any unauthorized access to the transported goods.

BRIEF DESCRIPTION OF THE SEVERAL VIEWS OF THE DRAWINGS

Further features and advantages of the present disclosure will become apparent from the following description of an embodiment of the present disclosure with reference to schematic drawings, without limiting the present disclosure as a result. In the drawings.

DETAILED DESCRIPTION

Figure 1:
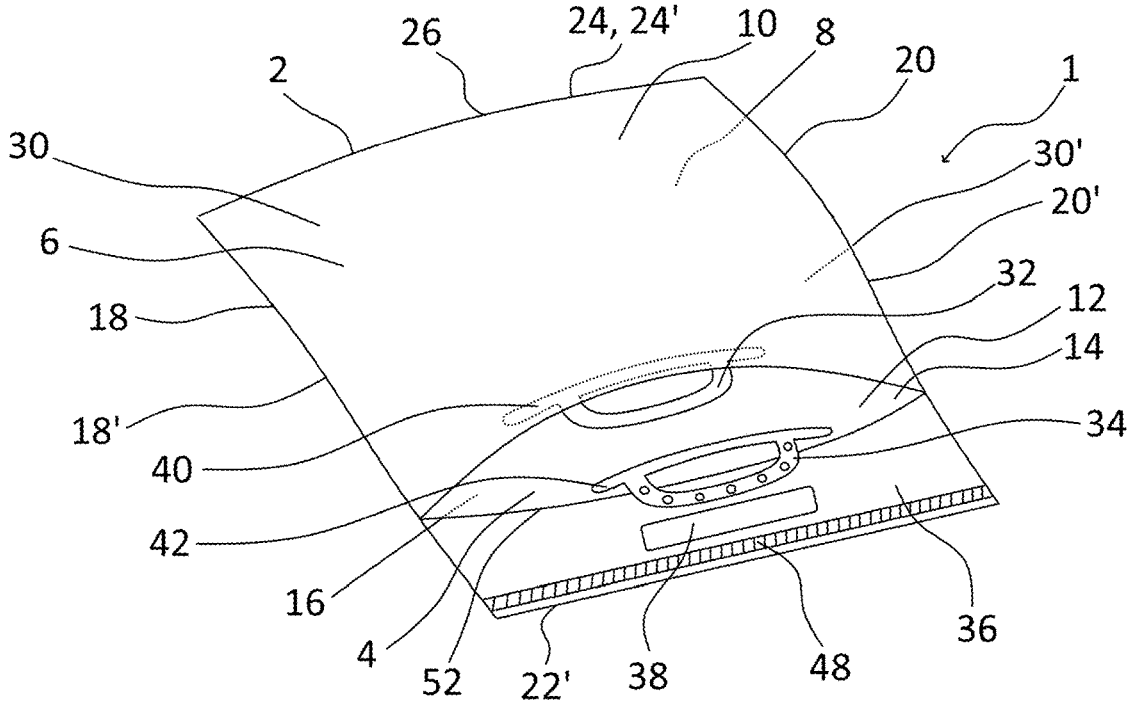
FIG. 1 is a schematic perspective plan view of a first embodiment of a plastics shipping bag according to the present disclosure without a perforation line in the open state.

Further to the above Brief Summary, in an expedient embodiment, it may be provided that the front wall and the rear wall are only designed to be at least triple-layered, quadruple-layered or quintuple-layered in the region close to the base, for example in the lower third thereof, in some cases including the base area, e.g., the base fold. The portions of the front wall and rear wall adjoining these portions can then be double-layered, for example.

In an embodiment, the closure flap may constitute a separate single-layered or multi-layered, in some cases double-layered, film layer, which is connected, for example bonded or welded, to the outer layer and/or the inner layer, in some cases the outer layer, of the rear wall. In some further cases, the closure flap is an integral part of the outer layer of the rear wall and is accordingly integrally formed therewith. In some other embodiments, the closure flap is double-layered and is expediently formed by folding the portion of the outer layer of the rear wall that projects beyond the opening edge of the front side onto itself, in some cases by forming a fold at the fold-over point. This embodiment saves material and at the same time provides a very stable bag that can be securely closed.

In one configuration of the plastics shipping bag according to the present disclosure, it is provided that the closure flap comprises at least one first weakened zone, which extends from or extends so as to be spaced from the first side edge towards or as far as the second side edge and in some cases extends from the first side edge as far as the second side edge, in the portion which is opposite the opening edge of the closure flap relative to the fastening means. This first weakened zone may be a perforation line, for example. Within the meaning of the present disclosure, a first weakened zone or perforation line is provided in the closure flap even if it extends in the region of or at the level of the opening edge of the front wall, in some cases substantially congruently with the extension of the opening edge of the front wall. In an expedient configuration of the plastics shipping bag according to the present disclosure, it is provided that the closure flap comprises the at least one first weakened zone, which extends from or extends so as to be spaced from the first side edge towards or as far as the second side edge and in some cases extends from the first side edge as far as the second side edge, in the portion which is opposite the fastening means relative to the passage opening.

In a suitable embodiment, it is provided that the first weakened zone, in some cases a perforation line, extends in a first portion from or extends so as to be spaced from the first side edge towards or as far as the opening, in some cases from the first side edge as far as the opening, and extends in a second portion from or extends so as to be spaced from the passage opening towards or as far as the second side edge, in some cases from the passage opening as far as the second side edge. In this embodiment, the passage opening is therefore part of the first weakened zone. In other words, in this embodiment the first weakened zone is divided into two portions, with the first portion of the first weakened zone extending from or extending so as to be spaced from the first side edge towards or as far as the portion of the passage opening adjacent thereto, and the second portion of the first weakened zone extending from or extending so as to be spaced from the second side edge towards or as far as the portion of the passage opening adjacent thereto. Within the meaning of the present disclosure, a passage opening is understood to mean an opening, including a slot, through which the handle loop or handle loop of the front wall and/or rear wall, in some cases of the front wall and rear wall, can be passed.

In the embodiment set out above, the first weakened zone is in some cases configured such that it occupies the shortest possible extension from the first side edge to the passage opening in the first portion and/or, in some cases and, such that it occupies the shortest possible extension from the passage opening to the second side edge in the second portion. In another expedient embodiment, this first weakened zone, in some cases a perforation line, extends in the closure flap substantially at the level of or substantially in parallel with the opening edge of the front wall or so as to be spaced therefrom in the direction of the opening edge of the closure flap by up to 2.5 or 1.5 cm.

For many applications, it has proved to be expedient that, in an embodiment, the plastics shipping bag according to the present disclosure is equipped with a closure flap that comprises at least one second weakened zone, in some cases a perforation line, which extends from or extends so as to be spaced from the first side edge, in some other cases extends from the first side edge, towards or as far as the second side edge, in some further cases as far as the second side edge, in the portion which extends from the passage opening as far as the fastening means. The second weakened zone has smaller spacing from the fastening means than the first weakened zone. The first and the second weakened zone in some cases extend substantially in parallel with one another.

In an expedient configuration of the plastics shipping bag according to the present disclosure, it is provided that the closure flap comprises the at least one second weakened zone, which extends from or extends so as to be spaced from the first side edge towards or as far as the second side edge and in some cases extends from the first side edge as far as the second side edge, in the portion which extends between the passage opening and the fastening means. In a suitable embodiment, it is provided that the second weakened zone, in some cases a perforation line, extends in a first portion from or extends so as to be spaced from the first side edge towards or as far as the opening, in some other cases from the first side edge as far as the opening, and extends in a second portion from or extends so as to be spaced from the passage opening towards or as far as the second side edge, in some cases from the passage opening as far as the second side edge. In this embodiment, the passage opening is therefore part of the second weakened zone. In other words, in this embodiment the second weakened zone is divided into two portions, with the first portion of the second weakened zone extending from or extending so as to be spaced from the first side edge towards or as far as the portion of the passage opening adjacent thereto, and the second portion of the second weakened zone extending from or extending so as to be spaced from the second side edge towards or as far as the portion of the passage opening adjacent thereto.

In the embodiment set out above, the second weakened zone is in some cases configured such that it occupies the shortest possible extension from the first side edge to the passage opening in the first portion and/or, in some cases, such that it occupies the shortest possible extension from the passage opening to the second side edge in the second portion.

The passage opening in the closure flap is in some cases formed as a handle hole or punched hole or as an opening slot. The passage opening is in some other cases arranged and oriented in the closure flap such that, when the closure flap is folded over onto the outer face of the front wall, the first handle or first handle loop and/or the second handle or second handle loop can be passed through this passage opening, thus closing the opening end of the plastics shipping bag. If the closure flap is multi-layered, in some cases double-layered, the peripheral edge of the handle hole or punched hole or the opening slot can be welded or bonded in portions or completely.

In the plastics shipping bags according to the present disclosure, the front wall and at the same time also the rear wall can be double-layered.

The at least one fastening means, which is between the opening edge and the passage opening, in some cases constitutes an adhesive area, and in some cases an adhesive strip. In an expedient configuration, this adhesive area or adhesive strip may be covered with a removable protective layer, for example in the form of siliconized paper. When the plastics shipping bag is to be closed, this protective layer needs to be removed before the closure flap containing the adhesive area or adhesive strip is folded over onto the outer face of the front wall and the closure flap comes into an adhesive connection with the outer face of the front wall, thus closing the openings.

The inner layer of the front wall and/or rear wall, in some cases of the front wall and rear wall, of the plastics shipping bag according to the present disclosure expediently includes or constitutes a foamed plastics film or an air-cushion plastics film, in some cases a foamed polyolefin film, in some other cases a foamed polyethylene film and in some other cases a foamed LD polyethylene film. It has proved suitable for many applications to draw on a closed-pore foamed plastics film when using a foamed plastics film.

Also when using at least one intermediate layer in the front wall and/or rear wall, this can in some cases be implemented as a closed-pore foamed plastics film or as an air-cushion plastics film. A foamed polyolefin film, in some cases a foamed polyethylene film and in some further cases a foamed LD polyethylene film, can be used here.

In some cases, the outer layer of the front wall and/or rear wall, in some other cases of the front wall and rear wall, does not include or constitute an air-cushion plastics film, or a foamed polyolefin film, in some further cases does not include or constitute a foamed polyolefin film, and in even some other cases does not include or constitute a foamed polyethylene film, and in some cases does not include or constitute a foamed LD polyethylene film. In another variant, the outer layer of the front wall and/or rear wall, in some cases of the front wall and rear wall, includes or constitutes a plastics film, in some cases a polyolefin film, and in some other cases a polyethylene film and in some further cases an LD polyethylene film.

For many uses, the plastics shipping bag according to the present disclosure does not have side walls or side folds.

The handles of the plastics shipping bags according to the present disclosure in some cases contain or are formed by HD polyethylene. In some further cases, LD polyethylene is used as a material for the inner layer and outer layer of the front wall and rear wall at the same time here. This consistently results in reliable welding of the handles to the front wall and/or rear wall.

Plastics shipping bags of this kind according to the present disclosure in which the handle of the front wall and the handle of the rear wall form a reversibly interconnectable handle pair have proved to be expedient. It has often proved to be expedient for the bag according to the present disclosure to connect the handle of the front wall to a weld strip. Expediently, the handle or handle loop of the front wall, in some cases the weld strip of the handle of the front wall, is welded to the inner face of the front wall, in some further cases to the folded-over extended edge portion, and in some even other cases in the overlapping portion of the inner layer and the extended edge portion as well as, optionally, the at least one intermediate layer. Alternatively and in some cases additionally, the handle of the rear wall is also connected to a weld strip. The handles of the front wall and rear wall can in some cases each be integral with the corresponding weld strip in this case. The handle or handle loop of the rear wall, in some cases the weld strip of the handle of the rear wall, can be welded to the inner face of the rear wall, in some cases to the folded-over extended edge portion, in some other cases to the overlapping portion of the inner layer with the folded-over extended edge portion as well as, optionally, the at least one intermediate layer.

The welding of the handle or handle loop of the front wall in some cases extends in the overlapping portion as far as the outer layer of the front wall. Alternatively and in some cases additionally, it may be provided that the welding of the handle or handle loop of the rear wall in the overlapping portion extends as far as the outer layer of the rear wall.

The weld strips of the plastics shipping bags according to the present disclosure in some cases contain or are formed by HD polyethylene. In some other cases, LD polyethylene is used as a material for the inner layer and outer layer of the front wall and rear wall at the same time here. This consistently results in reliable welding of the weld strips to the front wall and/or rear wall. For many applications, it has proved expedient to dimension the width of the weld strips to be less than the width of the front wall and/or rear wall. In this way, the weld strips can be conveniently and reliably connected to the inner layer of the front wall and/or rear wall.

The present disclosure also reliably provides such plastics shipping bags, in which the outer layer of the layer forming the front wall comprises an extended edge portion in the region of the opening edge, which extended edge portion is folded over onto the outer face of the inner layer of the front wall and forms an overlapping portion together with this inner layer, the extended edge portion and the inner layer being interconnected, in some cases welded to one another, in the overlapping portion. The region in which the connection or welding of the above-mentioned layers is provided is also called the "first connection area".

In an embodiment which satisfactorily provides the plastics shipping bag of the present disclosure, the extended edge portion, the inner layer and the outer layer or the extended edge portion, the inner layer, the at least one intermediate layer and the outer layer are expediently interconnected, in some cases welded to one another, in this first connection area. In some cases, the folded-over extended edge portion of the front wall substantially completely overlaps with the inner layer of the front wall. The adjacent layers are in some cases welded so as to overlap, i.e., the welding extends through all the layers in this region in a single region. In addition, it is likewise possible for the inner layer and the at least one intermediate layer or the at least one intermediate layer and the outer layer to be interconnected, in some cases welded to one another, in the overlapping portion.

In another embodiment, it may be provided, alternatively or in addition to the above-described variant, that the layer forming the outer layer of the rear wall comprises an extended edge portion in the region of the opening edge, which extended edge portion is folded over onto the outer face of the inner layer of the rear wall and forms an overlapping portion together with this inner layer, this extended edge portion and the inner layer and in some cases also the inner layer and the outer layer as well as, optionally, the inner layer and the at least one intermediate layer and the at least one intermediate layer and the outer layer being interconnected, in some cases welded to one another, in the overlapping portion. The region in which the connection or welding of the above-mentioned layers is provided is also called the "second connection area".

Alternatively and in some cases additionally, the layer forming the outer layer of the rear wall has an extended edge portion here in the region of the opening edge, which extended edge portion is folded over onto the outer face of the inner layer of the rear wall and forms an overlapping portion together with this inner layer, the extended edge portion and the inner layer being interconnected, in some cases welded to one another, in the overlapping portion. The folded-over extended edge portion of the rear wall in some other cases does not have any overlap with the inner layer of the rear wall in the region of the passage opening for the closure flaps.

In the plastics shipping bags according to the present disclosure, as set out above, in which the outer layer of the layer forming the front wall comprises an extended edge portion in the region of the opening edge and/or in which the layer forming the outer layer of the rear wall comprises an extended edge portion in the region of the opening edge, in generic use, the extension of the inner layer of the front wall towards the opening end and the extension of the inner layer of the rear wall towards the opening end in some cases substantially coincide.

In some suitable embodiments, the handle or handle loop of the front wall, in some cases the weld strip of the handle of the front wall, is connected, in some cases welded, to the region of the inner face of the front wall in a connection area, which is formed by the portion of the folded-over extended edge portion which does not have any overlap with the inner layer, in some cases only has an overlap with the outer layer of the front wall (also called the "third connection area"). Alternatively or additionally, it may be provided here that the handle or handle loop of the rear wall, in some cases the weld strip of the handle of the rear wall, is connected, in some cases welded, to the region of the inner face of the rear wall in a connection area, which is formed by the portion of the folded-over extended edge portion which does not have any overlap with the inner layer, in some cases only has an overlap with the outer layer of the rear wall (also called the "fourth connection area").

In order to bring about very good mechanical stability, the first and the third connection area are separate from one another in some cases. The second and the fourth connection area can also be separate from one another in this case.

Using the plastics shipping bags according to the present disclosure, it is surprisingly possible to ship foods, such as chilled foods, in a faultless and uncomplicated manner.

FIG. 1 is a schematic perspective plan view of a plastics shipping bag 1 according to the present disclosure comprising a closed base end 2 and an opposite opening end 4. The plastics shipping bag 1 has a front wall 6 having an inner face 8 and an outer face 10 and a rear wall 12 having an inner face 14 and an outer face 16. The front wall 6 and the rear wall 12 are each equipped with a first side edge 18, 18' and an opposite second side edge 20, 20' as well as an opening edge 22, 22' and a base edge 24, 24'. In the embodiment shown, the front wall 6 and the rear wall 12 are interconnected in the region of their first and second side edges 18, 18' and 20, 20' as well as by a base fold 26. In the variant shown, the front wall 6 and the rear wall 12 are double-layered, each including a foamed inner layer 28, 28' (not shown) and a single-layered, non-foamed outer layer 30, 30'.

In the plastics shipping bag 1 according to FIG. 1, a handle 32 is on the inside in the region of the opening edge 22 of the front wall 6. In the embodiment shown, the handle 32 is integrally connected to a weld strip 40, which in turn abuts and is welded to the outer face of the inwardly folded-over outer layer of the front wall of the plastics shipping bag 1 according to the present disclosure. Accordingly, a second handle 34 that is integrally connected to a weld strip 42 is on the inside in the region of the opening edge 22' of the rear wall 12, the weld strip 42 likewise being connected to the rear wall via the outer face of the inwardly folded-over outer layer by means of welding.

The front wall 6 has a length that is shorter than the length of the rear wall 12. Accordingly, the rear wall 12 projects beyond the front wall 6 at the opening end 4. This portion 36 that projects beyond the front wall 6 (also called the "closure flap") can be folded over onto the outer face of the front wall 6 and close the opening end 4 in this way. In the embodiment shown, this closure flap 36 is substantially centrally above a passage opening 38 (see also FIG. 2). The handles 32 and 34 of the front wall 6 and rear wall 12 can be passed through this passage opening 38. The closure flap 36 of the plastics shipping bag 1 according to FIG. 1 further comprises at least one fastening means in the form of an adhesive strip 48 between the opening edge 22, 22' and the passage opening 38. Once the closure flap 36 is folded over onto the outer face of the front wall 6, the opening end 4 can be closed in this way, which ensures secure and reliable transport as a result.

Figure 2:
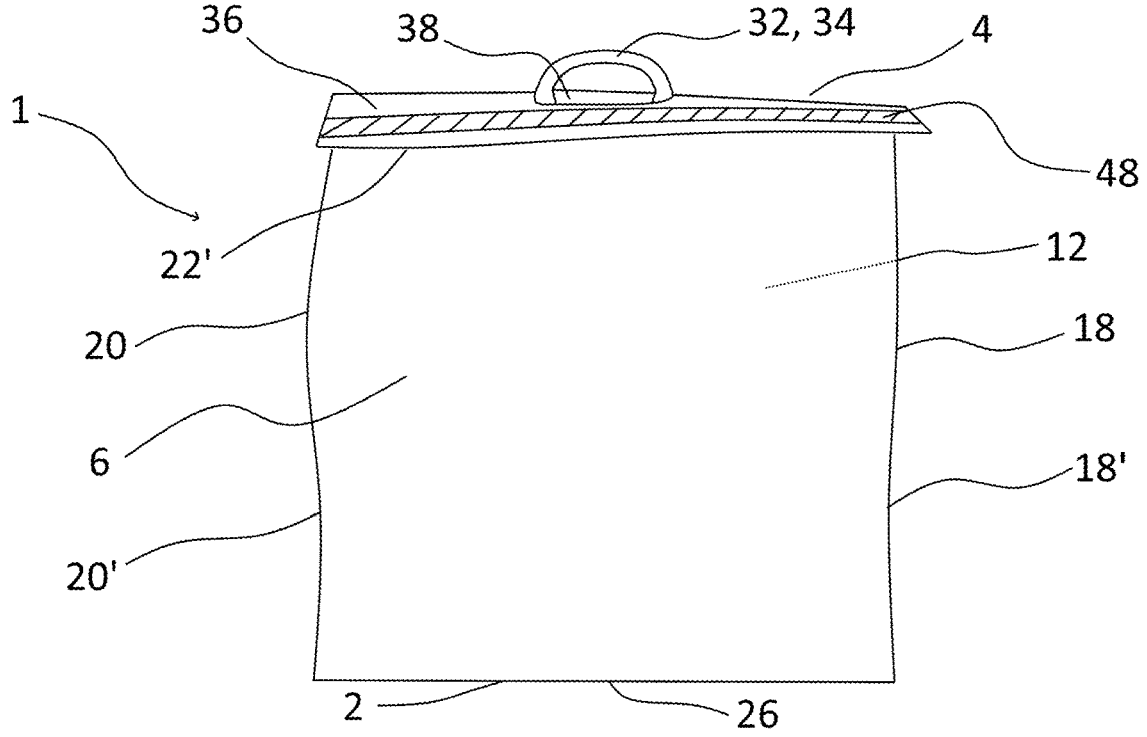
FIG. 2 is a schematic plan view of the front face of the plastics shipping bag according to the present disclosure according to FIG. 1 in the closed state.

FIG. 2 is a side view of the front wall 6 of the already described plastics shipping bag 1 according to the present disclosure in the closed state. In this case, the handle 32 of the front wall 6 and the handle 34 of the rear wall 12 are interconnected. The closure flap 36 is folded over onto the front wall 6. The closure flap 36 can be fastened to the front wall 6 by means of the fastening means in the form of the adhesive strip 48, the connected handles 32 and 34 being inserted through the passage opening 38.

Figure 3:
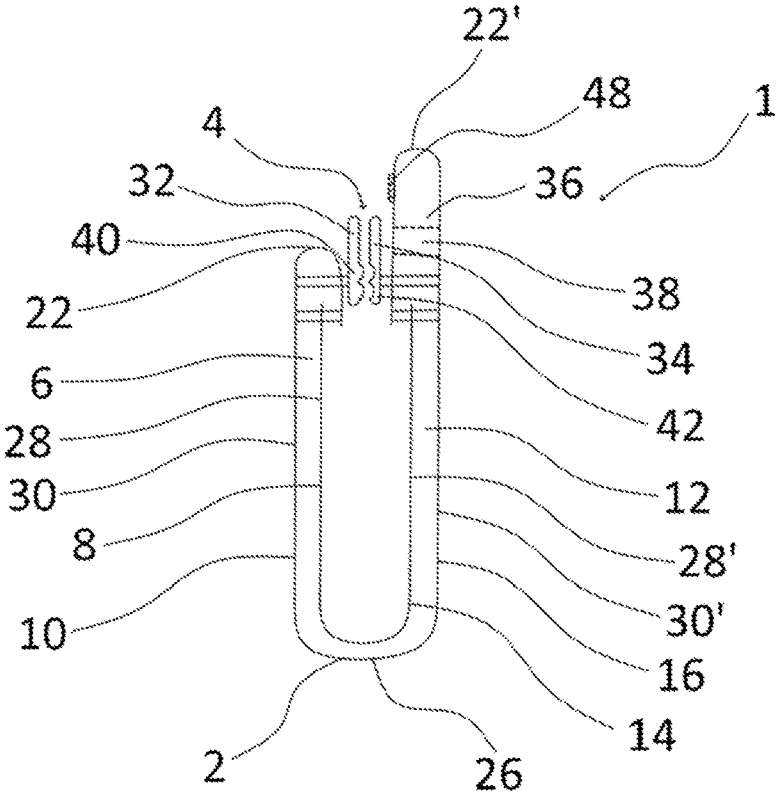
FIG. 3 is a schematic cross section through the plastics shipping bag according to the present disclosure according to FIG. 1 in the open state.

FIG. 3 is a cross section through the already described plastics shipping bag 1 in the open state. FIG. 3 shows that both the front wall 6 and the rear wall 12 are provided with an inner face 8, 14 and an outer face 10, 16, and, in the embodiment shown, are each double-layered, comprising an inner layer 28, 28' and an outer layer 30, 30'. In this case, the weld strips 40 and 42 are welded to the outer layer 30 of the front wall 6, which outer layer is folded over onto the inner face at the opening end, and to the outer layer 30' of the rear wall 12, which outer layer forms the closure flap and is folded over inwards at the opening end. The weld strip 40 and 42 of the front wall and rear wall are accordingly on the inside in the shipping bag according to the present disclosure as shown.

In the plastics shipping bag according to FIG. 3, the inner layer 28' of the rear wall 12 extends as far as the lower region of the closure flap 36, meaning that an overlapping area is formed. In this overlapping area, the inwardly folded-over outer layer 30' of the rear wall 12, forming the closure flap, the inner layer 28' of the rear wall 12, and the outer layer 30' of the rear wall 12, which is on the outside and is not folded over inwards, are adjacent in portions. In this overlapping region, in the embodiment shown the three above-mentioned overlapping layers are completely welded to one another in portions. Here, as shown in FIG. 3, the upper end of the inner layer 28' can end above the welding area. The handle 34 of the rear wall 12 is welded to the rear wall 12 on the inside, above this welding area and also above said upper end of the inner layer 28'. Accordingly, in the embodiment shown the above-described welding areas do not overlap, but instead are separate from one another.

The embodiment of a plastics shipping bag 1 according to the present disclosure according to FIG. 3 is further characterized in that the front wall 6 is provided with a corresponding overlapping region, in which the inner layer 28 of the front wall 6, the outer layer 30 of the front wall 6 on the outside, and the outer layer 30 of the front wall 6 that is folded over inwards at the opening end 4 are welded to one another. In the process, in the embodiment shown, the inner layer 28 does not extend again into the region in which the handle 32 of the front wall 6 is welded to the front wall 6 on the inside. Said welding areas on the front face are likewise separate from one another. The embodiment of a plastics shipping bag 1 according to the present disclosure shown in FIG. 3 is characterized by good stability, along with the lowest possible material costs. In this way, large loads can also be transported over a longer time period without any complications.

Figure 4:
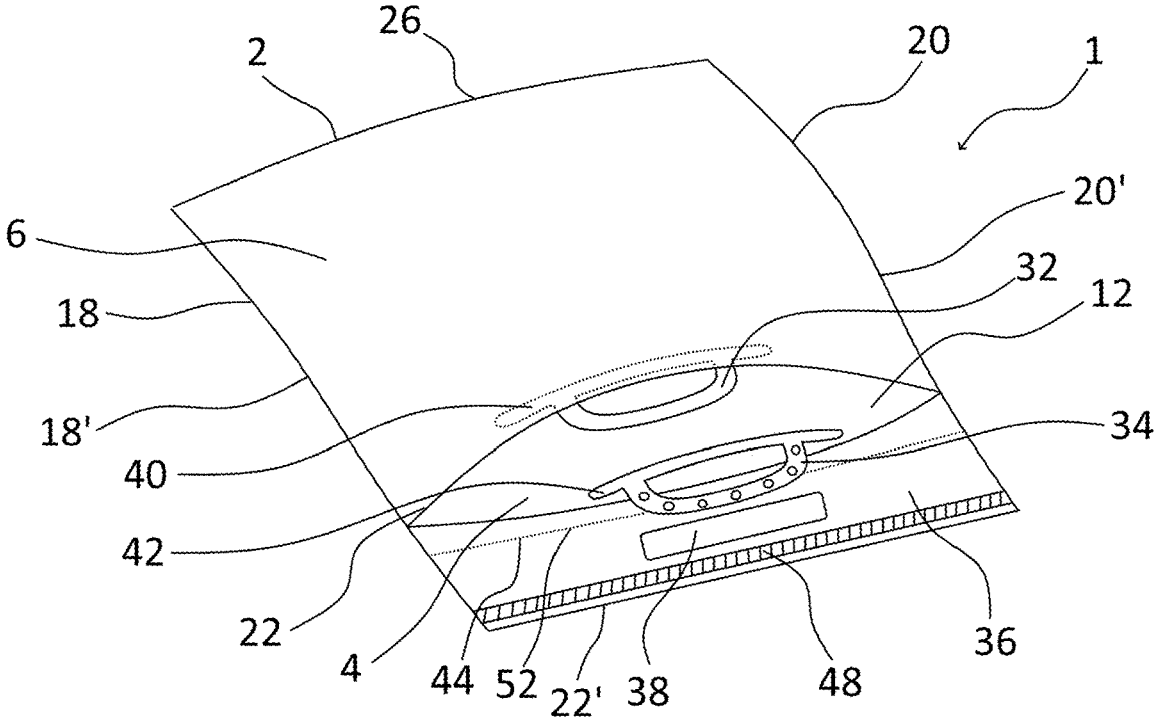
FIG. 4 is a schematic perspective plan view of a second embodiment of a plastics shipping bag according to the present disclosure with a perforation line in the open state.
Figure 5:
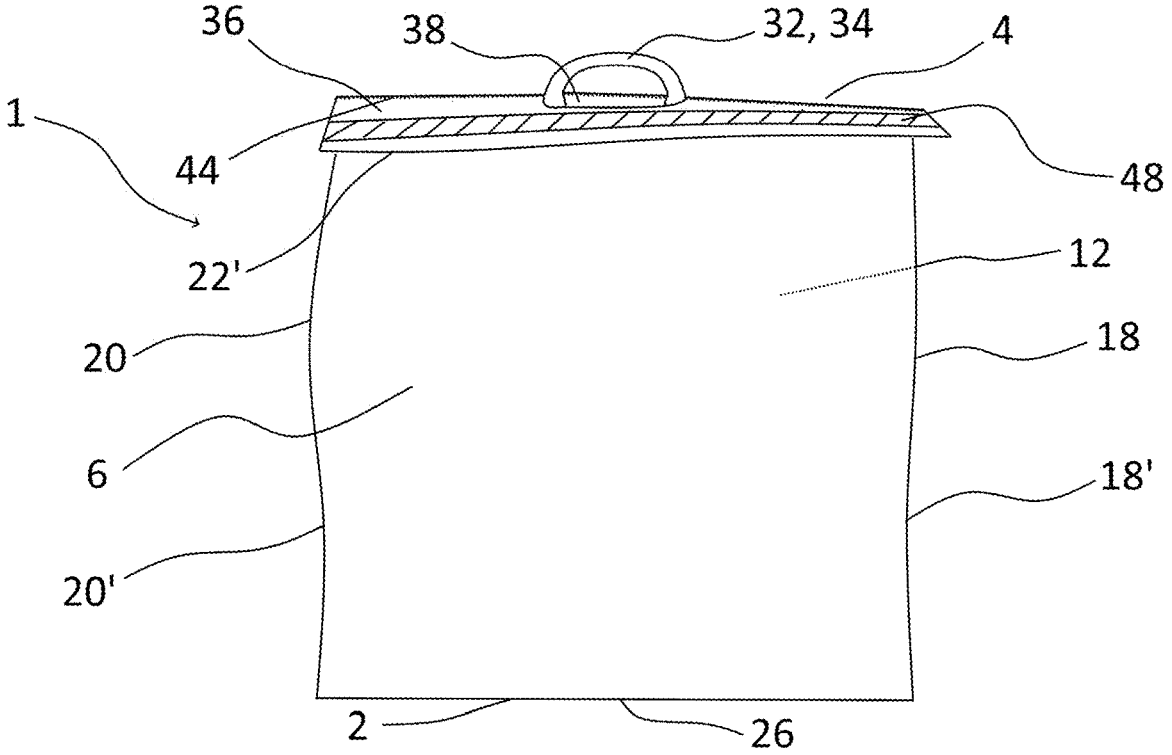
FIG. 5 is a schematic plan view of the front face of the plastics shipping bag according to the present disclosure according to FIG. 4 in the closed state.
Figure 6:
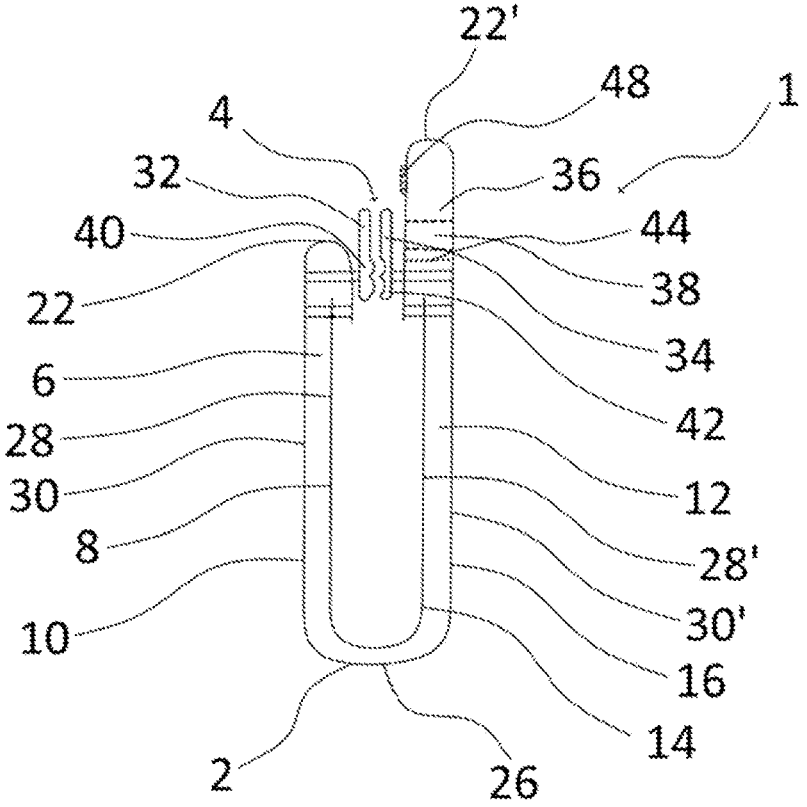
FIG. 6 is a schematic cross section through the plastics shipping bag according to the present disclosure according to FIG. 4 in the open state.

The second embodiment of the plastics shipping bag 1 according to the present disclosure in FIG. 4 comprises, in comparison with the plastics shipping bag 1 according to FIG. 1, a first weakened zone in the form of a perforation line 44, which extends in parallel with the upper opening edge 22' and is positioned centrally between the upper opening edge 22' of the rear wall 12 and the passage opening 38. When closing the plastics shipping bag 1 according to the present disclosure according to FIG. 5, in the process the closure flap 36 can be folded over the perforation line 44, said closure flap being fastened to the front wall 6 by means of an adhesive strip 48. FIG. 6 shows the associated cross section through the plastics shipping bag 1 shown in FIG. 4.

Figure 7:
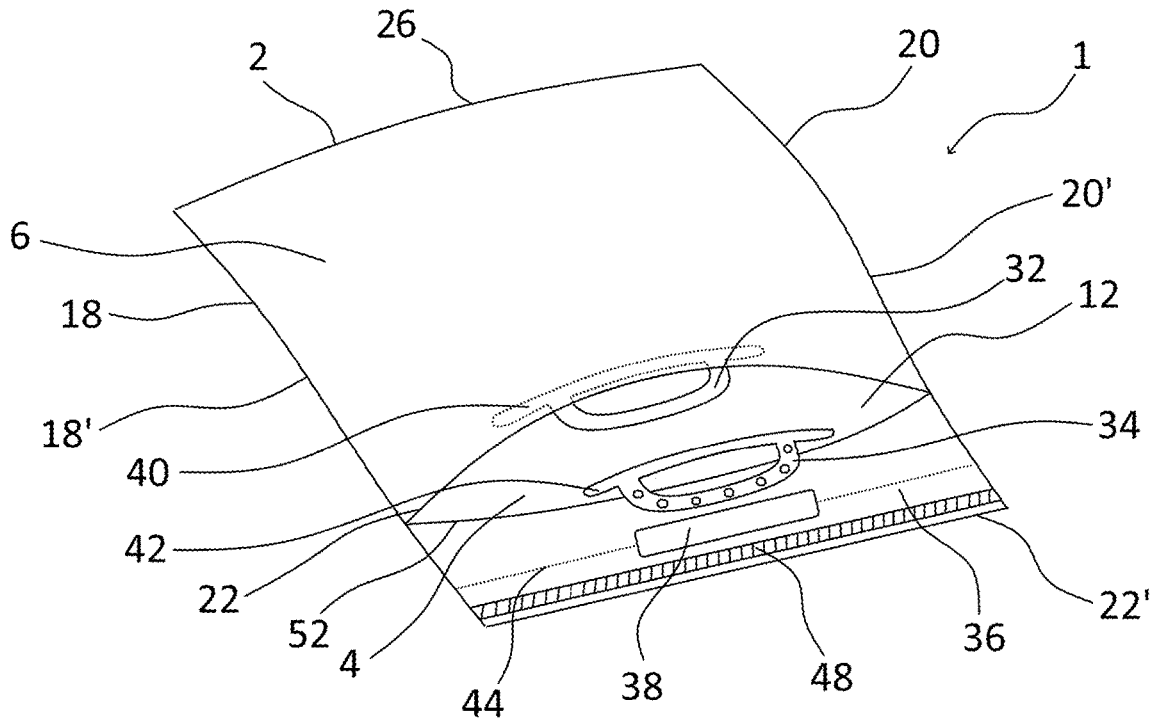
FIG. 7 is a schematic perspective plan view of a modification of a plastics shipping bag according to the present disclosure with a perforation line in the open state.
Figure 8:
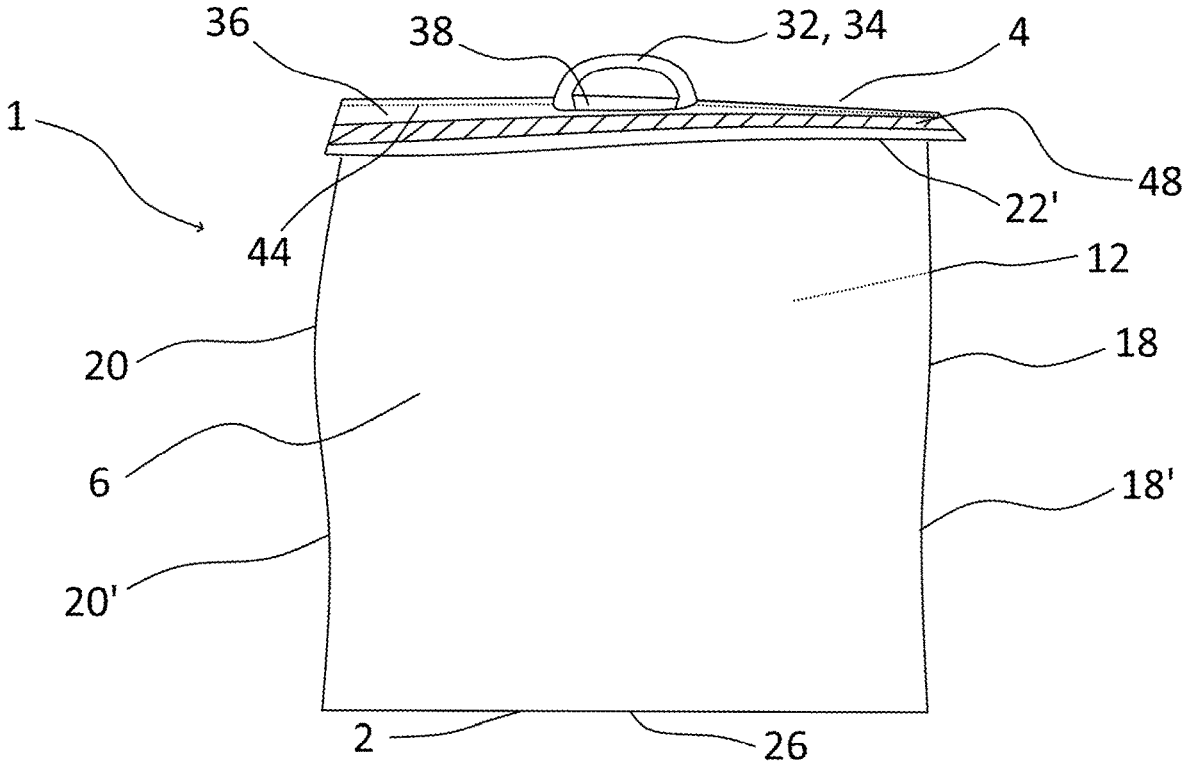
FIG. 8 is a schematic plan view of the front face of the plastics shipping bag according to the present disclosure according to FIG. 7 in the closed state.
Figure 9:
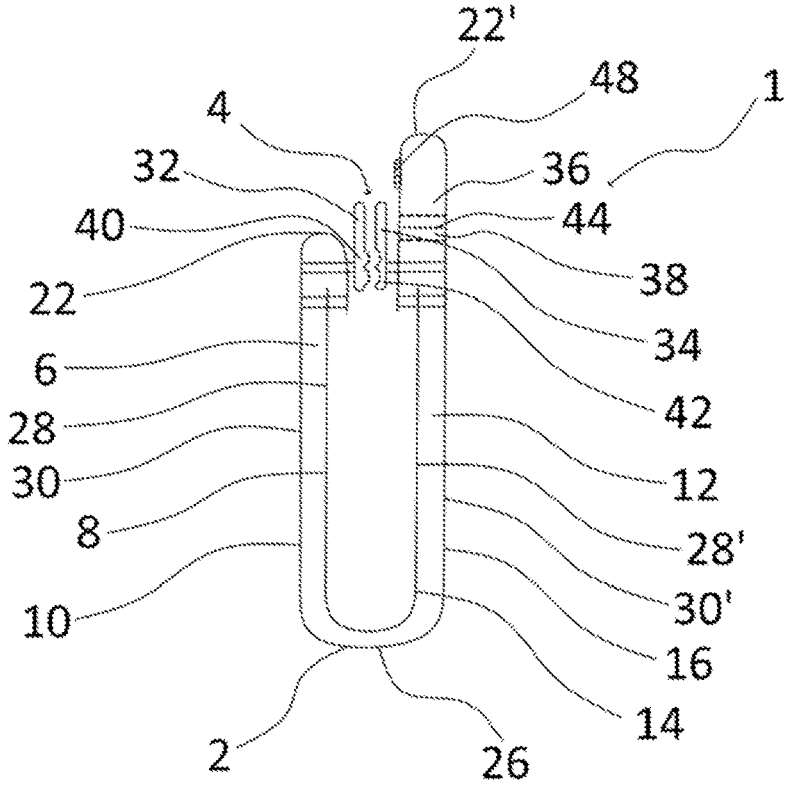
FIG. 9 is a schematic cross section through the plastics shipping bag according to the present disclosure according to FIG. 7 in the open state.

The alternative embodiment of the plastics shipping bag 1 according to the disclosure having a perforation line according to FIG. 7 differs from the plastics shipping bag according to FIG. 4 in that the first weakened zone in the form of a perforation line 44 extends, in a first portion, from the first side edge 18 as far as the center of the closest short side of the rectangular passage opening 38 and extends, in a second portion, from the center of the opposite short side of the rectangular passage opening 38 as far as the second side edge 18'. FIGS. 8 and 9 show the associated plastics shipping bag 1 according to FIG. 7 in the closed state in a side view and in a cross section, respectively.

Figure 10:
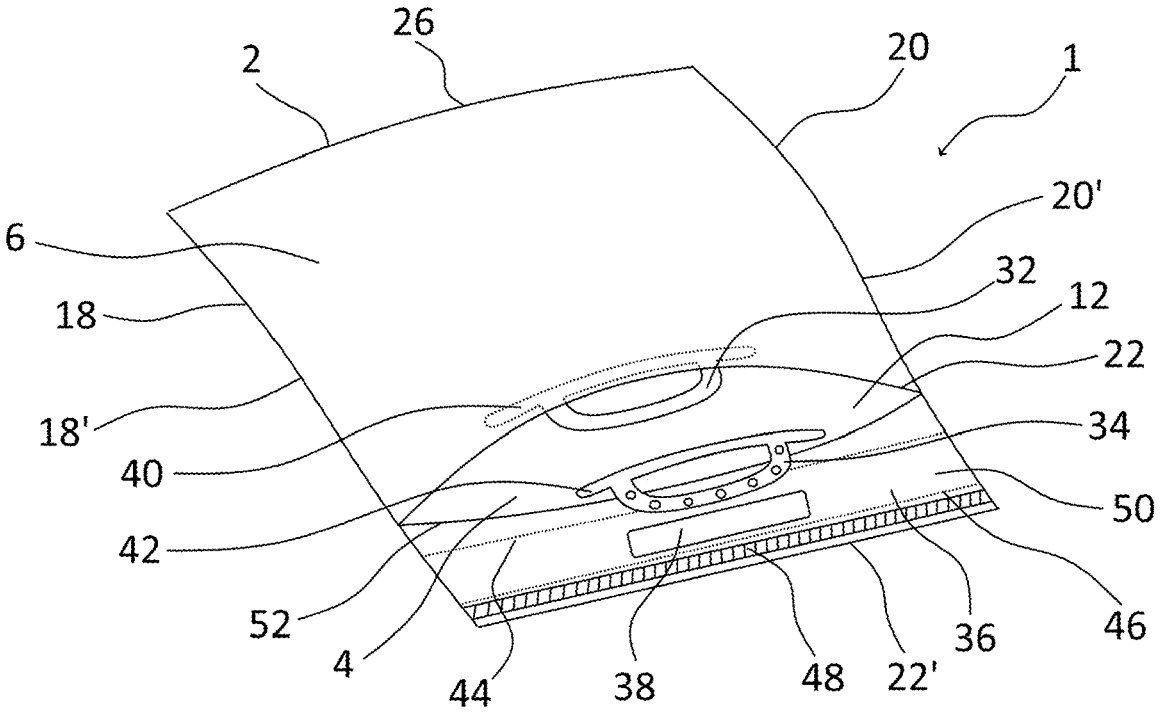
FIG. 10 is a schematic perspective plan view of a third embodiment of a plastics shipping bag according to the present disclosure with two perforation lines in the open state.

FIG. 10 shows a third embodiment of the plastics shipping bag 1 according to the present disclosure in a perspective plan view. In addition to the features of the embodiment of the plastics shipping bag 1 shown in FIG. 4, said bag comprises another perforation line 46 on the rear wall 12, which is located between the passage opening 38 and the adhesive strip 48. The plastics shipping bag 1 according to the present disclosure that is closed by means of the adhesive strip 48 can be opened by tearing open the first perforation line 44 or by tearing open the second perforation line 46, in order to remove the transported goods. The remaining portion 50 can then be detached by tearing open either the second perforation line 46 or the first perforation line 44.

When using a plastics shipping bag having just one perforation line, irrespective of where this was arranged, i.e., on one side or the other of the passage opening 38, a portion 50 connected to the bag would remain, either as an upwardly protruding portion of the adhesive strip or as a downwardly protruding portion of the rear wall, which could impair the filling process when reusing the opened plastics shipping bag as a carrier bag or cool bag. This protruding portion, which is still connected to the body of the bag, could also increase the risk of damaging the bag. For example, the protruding portion could get caught on other objects during handling and/or transport. In addition, an upwardly protruding portion would result in a look that would be detrimental to reusing the bag as a carrier bag or cool bag. Alternatively, it is of course also possible to tear off the first and the second perforation line 44, 46 substantially simultaneously by pulling on the outer edge of the portion 50, in order to thus remove it in one action. By the variant according to FIG. 10 allowing the protruding portion 50 to be easily torn off, it becomes easier to reuse the plastics shipping bag 1.

Figure 11:
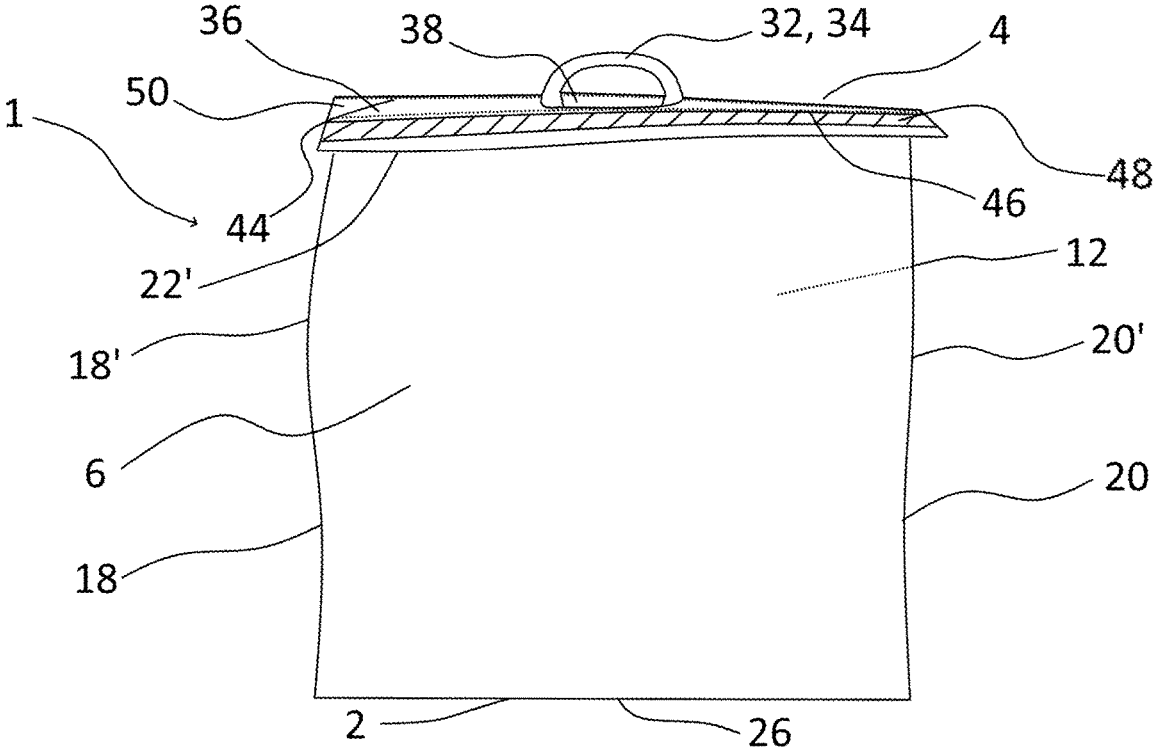
FIG. 11 is a schematic plan view of the front face of the plastics shipping bag according to the present disclosure according to FIG. 10 in the closed state.
Figure 12:
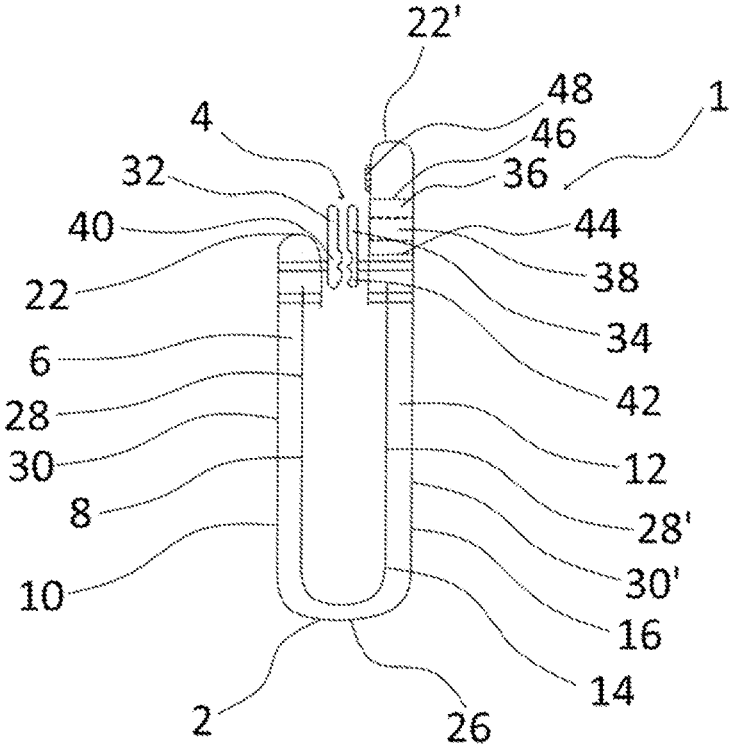
FIG. 12 is a schematic cross section through the plastics shipping bag according to the present disclosure according to FIG. 10 in the open state.

FIG. 11 is a side view of the plastics shipping bag 1 according to the present disclosure according to FIG. 10 in the closed state. After opening the plastics carrier bag 1 by opening the first perforation line 44, the portion 50, which has become superfluous, can be torn off by means of the second perforation line 46. FIG. 12 shows the associated cross section through the plastics carrier bag 1, which has already been described in FIG. 10.

Figure 13:
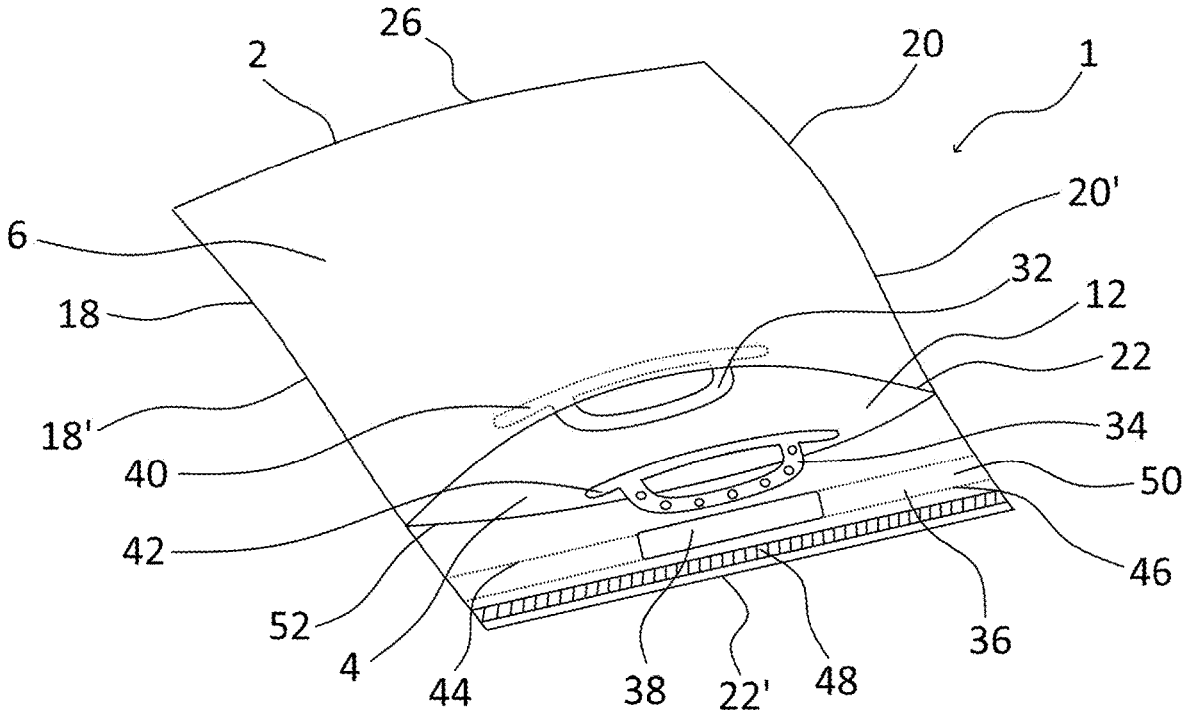
FIG. 13 is a schematic perspective plan view of a modification of a plastics shipping bag according to the present disclosure with two perforation lines in the open state.
Figure 14:
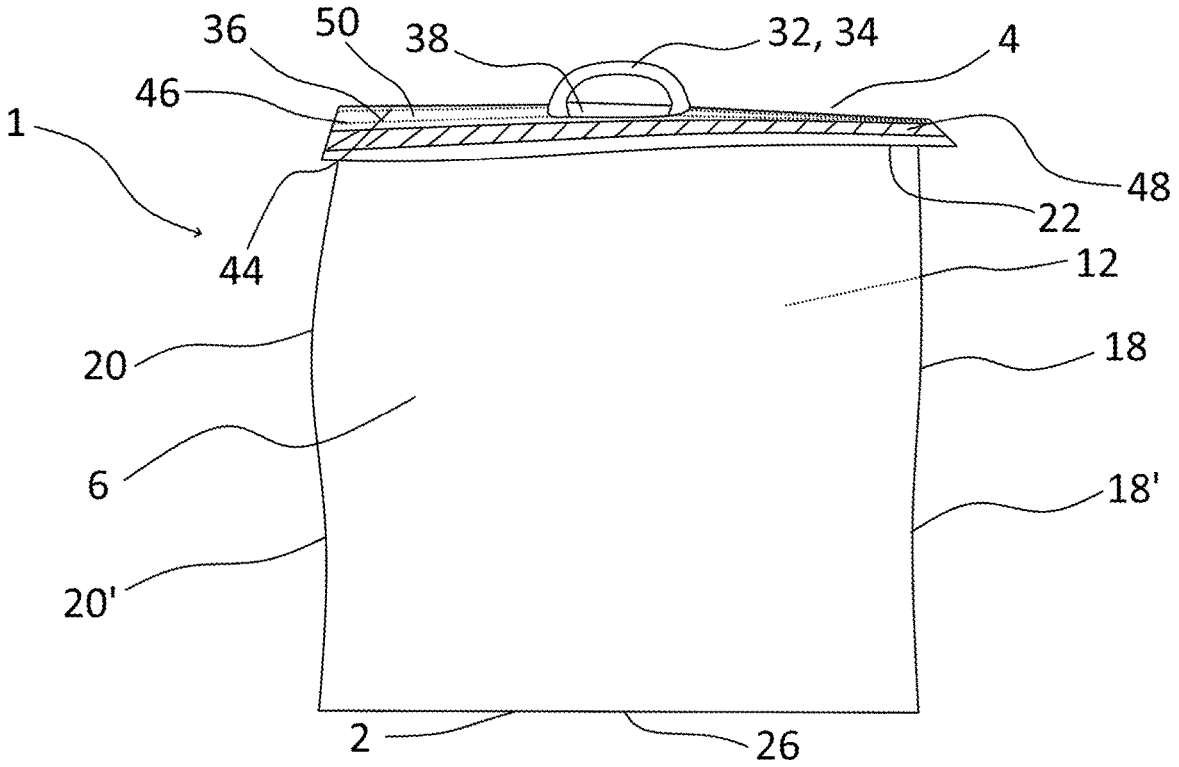
FIG. 14 is a schematic plan view of the front face of the plastics shipping bag according to the present disclosure according to FIG. 13 in the closed state.
Figure 15:
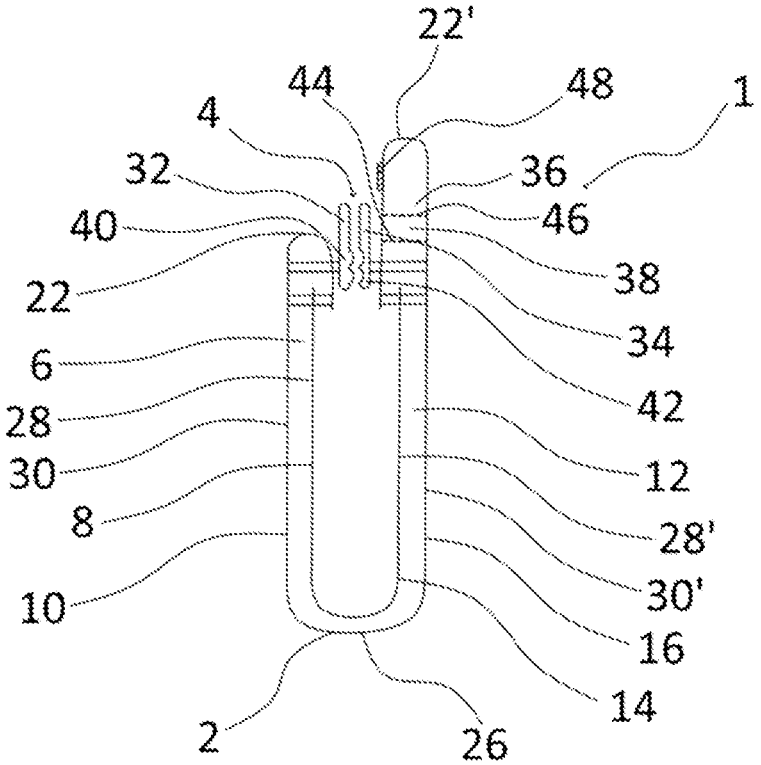
FIG. 15 is a schematic cross section through the plastics shipping bag according to the present disclosure according to FIG. 13 in the open state.

The variant of the plastics shipping bag according to FIG. 13 differs from the plastics shipping bag according to FIG. 10 in that the first weakened zone in the form of a perforation line 44 extends, in a first portion, from the first side edge as far as a first corner point of the rectangular passage opening, which is a greater distance from the fastening means than the second corner point, which, together with the first corner point, spans the first, short side of the rectangular passage opening 38, which is adjacent to the first side edge 18, and extends, in a second portion, from the third corner point of rectangular passage opening 38, which, together with the first corner point, spans the first, longer side of the rectangle, as far as the second side edge 18'. Moreover, the second weakened zone in the form of a perforation line 46 extends, in a first portion, from the first side edge 18 as far as the second corner point of the rectangular passage opening 38 and extends, in a second portion, from the fourth corner point of the rectangular passage opening 38, which, together with the third corner point, spans the second, shorter side of the rectangular passage opening 38, as far as the second side edge 18'. In this embodiment, the plastics shipping bag 1 according to the present disclosure, which is closed by the fastening means 48, can be conveniently and reliably opened and simultaneously transferred into a state in which it can be reused as a carrier bag or cool bag without any problems by pulling on the portions between the first and second weakened zones 44 and 46. FIGS. 14 and 15 show the associated views of the closed state, in a side view and in a cross section, respectively.

Figure 16:
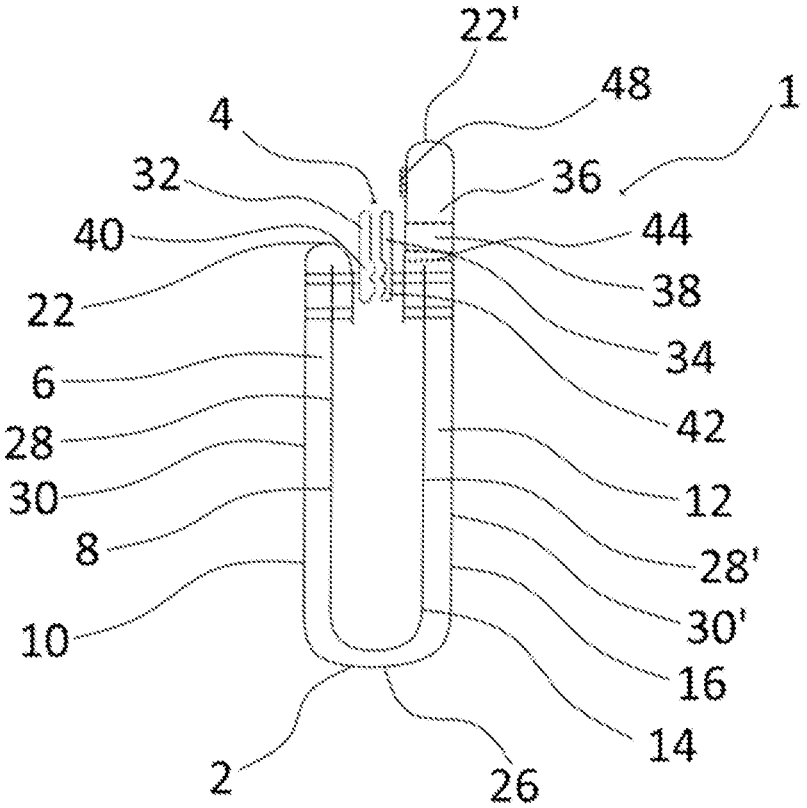
FIG. 16 is a schematic cross section through another modification of the plastics shipping bag according to the present disclosure.

The plastics shipping bag according to the present disclosure according to FIG. 16 differs from the variant in the preceding figures in that the inner layer 28' of the rear wall 12 extends beyond the welding area of the handle. That is to say, the inner layer 28' is fixed to the opening end by two successive welding areas. In the embodiment shown, the inner layer 28 of the front wall 6 is likewise fixed by two welding areas in a corresponding manner.

Figure 17:
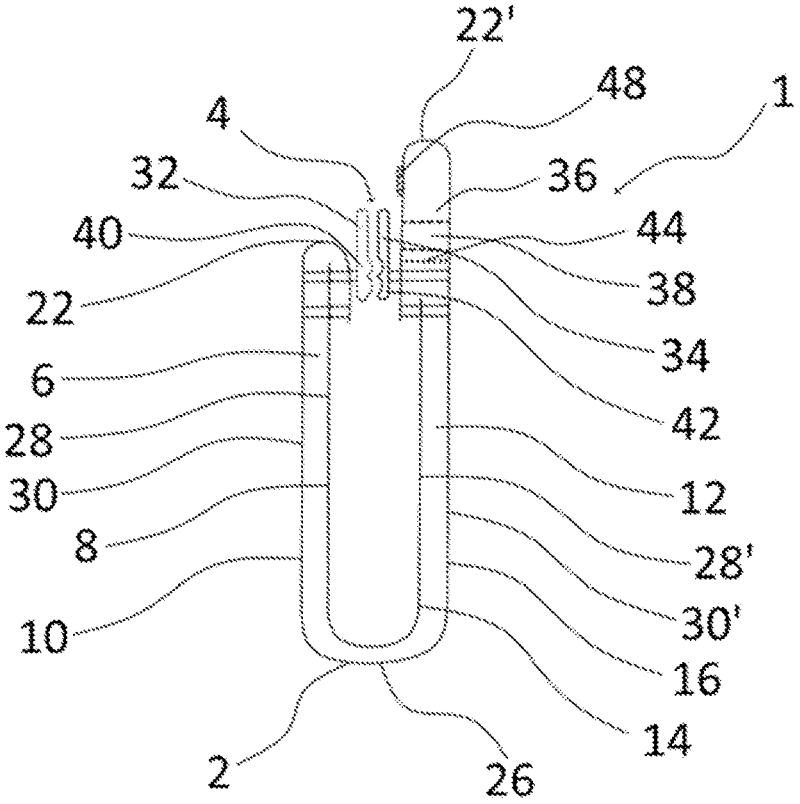
FIG. 17 is a schematic cross section through another modification of the plastics shipping bag according to the present disclosure.
Figure 18:
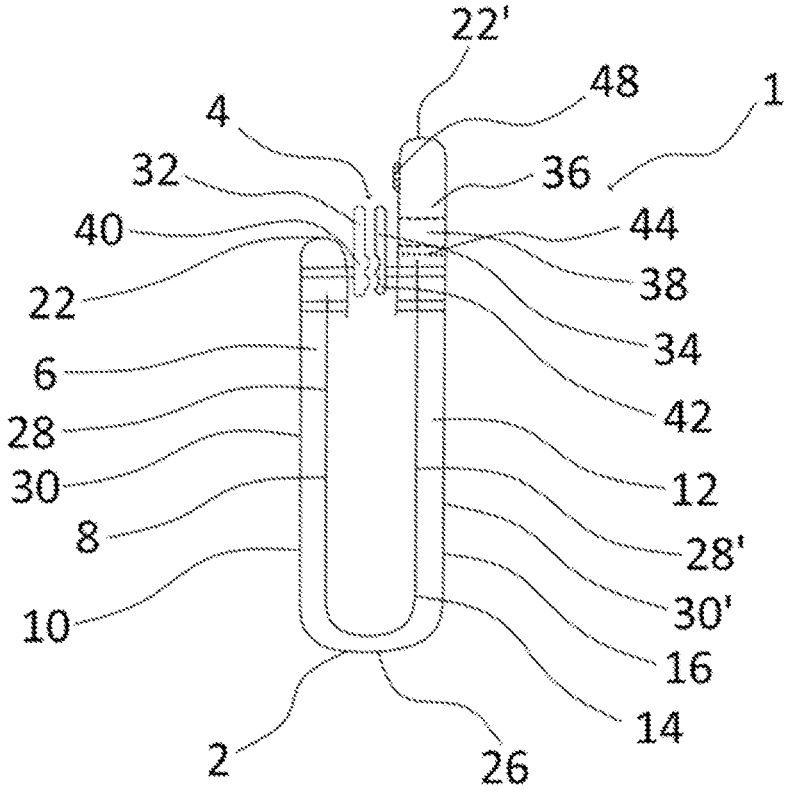
FIG. 18 is a schematic cross section through another modification of the plastics shipping bag according to the present disclosure.

The plastics shipping bags according to FIGS. 17 and 18 differ from the variant according to FIG. 16 in that the inner layer is fixed by two adjacent welding areas only on the front side (FIG. 17) or only on the rear side (FIG. 18), i.e., the remaining inner layer of the rear wall or front wall is fixed only by one welding area in the embodiments in FIGS. 1 to 15.

The features of the present disclosure disclosed in the preceding description, the claims and the drawings can be essential to the implementation of the present disclosure in their various embodiments both individually and in any combination.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A plastics shipping bag, comprising:

a closed or substantially closed base end and an opposite opening end;

a front wall having an inner face and an outer face, each face having a first side edge and an opposite second side edge as well as an opening edge and a base edge;

a rear wall having an inner face and an outer face, each face having a first side edge and an opposite second side edge as well as an opening edge and a base edge, wherein the front wall and the rear wall are interconnected at least in portions, directly or by way of side walls and/or side folds and/or a base area in a region of their first and second side edges and base edges, wherein the front wall, or the front wall and the rear wall, or the front wall, the rear wall and the side walls, are designed to be multi-layered at least in portions, including an inner layer and an outer layer or an inner layer, an outer layer and at least one intermediate layer; and at least one handle or handle loop attached to the opening edge, the inner face or the outer face of the front wall, and/or at least one handle or handle loop attached to the inner face of the rear wall below the opening edge, wherein the front wall has a first length which corresponds to the average distance between the opening edge and the base edge of the front wall, and wherein the rear wall has a second length which corresponds to the average distance between the opening edge and the base edge of the rear wall, wherein the first length is shorter than the second length, such that the rear wall projects beyond the front wall at the opening end and this portion of the rear wall projecting beyond the front wall forming a closure flap can be folded onto the outer face of the front wall, wherein the closure flap comprises a passage opening which is configured and designed for the passage of the handle loop or handle of the front wall and/or rear wall, wherein the closure flap comprises at least one fastener between the opening edge of the rear wall and the passage opening, which fastener is configured and designed to close the opening end once the closure flap has been folded over onto the outer face of the front wall, and wherein the layer forming the outer layer of the front wall comprises an extended edge portion in a region of the opening edge, which extended edge portion is folded over onto the outer face of the inner layer of the front wall and forms an overlapping portion together with this inner layer, and wherein the extended edge portion and the inner layer, or the extended edge portion, the inner layer and also the inner layer and the outer layer, or the inner layer and the at least one intermediate layer and the at least one intermediate layer and the outer layer, are interconnected in the overlapping portion forming a first connection area.

2. The plastics shipping bag according to claim 1, wherein the closure flap comprises at least one first weakened zone, which extends from or extends so as to be spaced from the first side edge towards or as far as the second side edge, in the portion which is opposite the fastener relative to the passage opening.

3. The plastics shipping bag according to claim 1, wherein the front wall and the rear wall are double-layered, triple-layered, quadruple-layered, or quintuple-layered, at least in portions.

4. The plastics shipping bag according to claim 2, wherein the closure flap comprises at least one second weakened zone which extends from or extends so as to be spaced from the first side edge towards or as far as the second side edge, in the portion which extends from the passage opening as far as the fastener.

5. The plastics shipping bag according to claim 1, wherein the inner layer of the front wall and/or rear wall includes or constitutes a foamed plastics film or an air-cushion plastics film, and the outer layer of the front wall and/or rear wall does not comprise or constitute an air-cushion plastics film or comprises or constitutes a non-foamed plastics film.

6. The plastics shipping bag according to claim 1, wherein the at least one intermediate layer of the front wall and/or rear wall includes or constitutes a foamed plastics film or an air-cushion plastics film.

7. The plastics shipping bag according to claim 1, wherein the handle of the front wall is connected to a weld strip, and/or wherein the handle on the rear wall is connected to a weld strip.

8. The plastics shipping bag according to claim 1, wherein the layer forming the outer layer of the rear wall comprises an extended edge portion in a region of the opening edge, which extended edge portion is folded over onto the outer face of the inner layer of the rear wall and forms an overlapping portion together with this inner layer, and wherein the extended edge portion and the inner layer, or the extended edge portion, the inner layer and also the inner layer and the outer layer, or the inner layer and the at least one intermediate layer and the at least one intermediate layer and the outer layer, are interconnected in the overlapping portion forming a second connection area.

9. The plastics shipping bag according to claim 8, wherein the folded-over extended edge portion of the front wall substantially completely overlaps with the inner layer of the front wall, and the folded-over extended edge portion of the rear wall does not have any overlap with the inner layer of the rear wall in a region of the passage opening for the closure flaps.

10. The plastics shipping bag according to claim 8, wherein the inner layer of the front wall has an extension towards the opening end and the inner layer of the rear wall has an extension towards the opening end which substantially coincide.

11. The plastics shipping bag according to claim 1, wherein:

the handle or handle loop of the front wall is welded to the inner face of the front wall, and/or the handle or handle loop of the rear wall is welded to the inner face of the rear wall.

12. The plastics shipping bag according to claim 8, wherein:

the handle or handle loop of the front wall is connected to a region of the inner face of the front wall in a third connection area, which is formed by a portion of the folded-over extended edge portion which does not have any overlap with the inner layer, and/or the handle or handle loop of the rear wall is connected to a region of the inner face of the rear wall in a fourth connection area, which is formed by a portion of the folded-over extended edge portion which does not have any overlap with the inner layer.

13. The plastics shipping bag according to claim 12, wherein the first and the third connection area are separate from one another and/or the second and the fourth connection area are separate from one another.

14. The plastics shipping bag according to claim 11, wherein:

the welding of the handle or handle loop of the front wall in the overlapping portion extends as far as the outer layer of the front wall, and/or the welding of the handle or handle loop of the rear wall in the overlapping portion extends as far as the outer layer of the rear wall.

15. The plastics shipping bag according to claim 1, wherein the closure flap constitutes an integral or separate single-layered or multi-layered film layer, which is connected to or integrally formed with the outer layer or the inner layer of the rear wall, or wherein the closure flap is an integral part of the outer layer of the rear wall.

16. The plastics shipping bag according to claim 4, wherein:

the first weakened zone extends in a first portion from or extends so as to be spaced from the first side edge towards or as far as the passage opening, and extends in a second portion from or extends so as to be spaced from the passage opening towards or as far as the second side edge, and/or the second weakened zone extends in a first portion from or extends so as to be spaced from the first side edge towards or as far as the passage opening, and extends in a second portion from or extends so as to be spaced from the passage opening towards or as far as the second side edge.

17. The plastics shipping bag according to claim 2, wherein the first weakened zone comprises at least one perforation line.

18. The plastics shipping bag according to claim 4, wherein the second weakened zone is a perforation line.

19. The plastics shipping bag according to claim 5, wherein the foamed plastics film or the air-cushion plastics film of the inner layer of the front wall and/or rear wall is a foamed polyethylene film.

20. The plastics shipping bag according to claim 7, wherein the handle of the front wall and the weld strip connected thereto are made of HD polyethylene, and/or wherein the handle on the rear wall and the weld strip connected thereto are made of HD polyethylene.

21. The plastics shipping bag according to claim 11, wherein:

a weld strip of the handle of the front wall is welded to the inner face of the front wall in the overlapping portion of the inner layer and the extended edge portion or in the overlapping portion of the inner layer, the extended edge portion and the at least one intermediate layer, and/or a weld strip of the handle of the rear wall is welded to the overlapping portion of the inner layer and the folded-over extended edge portion or to the overlapping portion of the inner layer, the folded-over extended edge portion, and the at least one intermediate layer.

22. The plastics shipping bag according to claim 12, wherein:

a weld strip of the handle of the front wall is welded to the region of the inner face of the front wall in the third connection area, which third connection area only has an overlap with the outer layer of the front wall, and/or a weld strip of the handle of the rear wall is welded to the region of the inner face of the rear wall in the fourth connection area, which fourth connection area only has an overlap with the outer layer of the rear wall.

23. The plastics shipping bag according to claim 16, wherein:

the first weakened zone extends in a first portion from the first side edge as far as the passage opening, and in a second portion from the passage opening as far as the second side edge, and/or the second weakened zone extends in a first portion from the first side edge as far as the passage opening, and extends in a second portion from the passage opening as far as the second side edge.

24. The plastics shipping bag according to claim 1, wherein the folded-over extended edge portion of the front wall substantially completely overlaps with the inner layer of the front wall.

25. A plastics shipping bag, comprising:

a closed or substantially closed base end and an opposite opening end;

a front wall having an inner face and an outer face, each having a first side edge and an opposite second side edge as well as an opening edge and a base edge;

a rear wall having an inner face and an outer face, each face having a first side edge and an opposite second side edge as well as an opening edge and a base edge, wherein the front wall and the rear wall are interconnected at least in portions, directly or by way of side walls and/or side folds and/or a base area in the region of their first and second side edges and base edges, wherein the front wall, or the front wall and the rear wall, or the front wall, the rear wall and the side walls, are designed to be multi-layered at least in portions, including an inner layer and an outer layer or an inner layer, an outer layer and at least one intermediate layer; and at least one handle or handle loop attached to the opening edge, the inner face or the outer face of the front wall, and/or at least one handle or handle loop attached to the inner face of the rear wall below the opening edge, wherein the front wall has a first length which corresponds to the average distance between the opening edge and the base edge of the front wall, and wherein the rear wall has a second length which corresponds to the average distance between the opening edge and the base edge of the rear wall, wherein the first length is shorter than the second length, such that the rear wall projects beyond the front wall at the opening end and this portion of the rear wall projecting beyond the front wall forming a closure flap can be folded onto the outer face of the front wall, wherein the closure flap comprises a passage opening which is configured and designed for the passage of the handle loop or handle of the front wall and/or rear wall, wherein the closure flap comprises at least one fastener between the opening edge of the rear wall and the passage opening, which fastener is configured and designed to close the opening end once the closure flap has been folded over onto the outer face of the front wall, and wherein the layer forming the outer layer of the rear wall comprises an extended edge portion in a region of the opening edge, which extended edge portion is folded over onto the outer face of the inner layer of the rear wall and forms an overlapping portion together with this inner layer, and wherein the extended edge portion and the inner layer, or the extended edge portion, the inner layer and also the inner layer and the outer layer, or the inner layer and the at least one intermediate layer and the at least one intermediate layer and the outer layer, are interconnected in the overlapping portion forming a second connection area.

26. The plastics shipping bag according to claim 25, wherein the folded-over extended edge portion of the rear wall does not have any overlap with the inner layer of the rear wall in a region of the passage opening for the closure flaps.

* * * * *